US005359990A

United States Patent [19]

Hsu

[11] Patent Number: 5,359,990

[45] Date of Patent: Nov. 1, 1994

[54] OILY SMOKE TREATING AND EXHAUSTING DEVICE

[76] Inventor: Teng-Hsien Hsu, No. 105, Lin-Hsi St., Lin-Ya Dist., Kaohsiung, Taiwan, Province of China.

[21] Appl. No.: 145,237

[22] Filed: Nov. 3, 1993

[51] Int. Cl.[5] ..... F24C 15/20

[52] U.S. Cl. ..... 126/299 E; 126/299 D; 55/233; 55/429; 55/DIG. 36; 55/228

[58] Field of Search ..... 126/299 D, 299 E, 299 F; 55/429, 432, 428, DIG. 36, 229, 233, 234, 220, 227, 228, 210, 212

[56] References Cited

U.S. PATENT DOCUMENTS 2,539,344 1/1951 Carraway ..... 126/299 E
3,563,005 2/1971 Jones ..... 126/299 E
4,231,765 11/1980 Scott ..... 126/299 E
4,407,266 10/1983 Molitor ..... 126/299 E
4,753,218 6/1988 Potter ..... 126/299 E

*Primary Examiner*—James C. Yeung
*Attorney, Agent, or Firm*—Jacobson, Price, Holman & Stern

[57] ABSTRACT

An oily smoke treating and exhausting device for cooking equipment, has an upper smoke housing, two vertical passageways formed by three vertical plates extending down and up from the housing for oily smoke produced in cooking to be showered with water to let oil in the smoke be mixed with water and drop down into a separating tank so that oil may float on top of water in the tank and overflow into a waste oil tank to be exhausted.

2 Claims, 3 Drawing Sheets

OILY SMOKE TREATING AND EXHAUSTING DEVICE

BACKGROUND OF THE INVENTION

A conventional oily smoke exhauster generally comprises an upper horizontal housing for treating oily smoke produced from cooking food in a utensil below the housing and pumping the smoke out through an air hole in the housing by means of a fan. But oil mixed in the smoke is not eliminated so portions of smoke passageways may be coated with sticky oil which is extremely hard to clean off.

SUMMARY OF THE INVENTION

This invention has been devised to offer an oily smoke treating and exhausting device attachable to a cooking stove so as to remove oil mixed in oily smoke produced by a cooking food in a cooking utensil.

An oily smoke treating and exhausting device of the present invention comprises an upper horizontal housing mounted on a cooking stove, two passageways formed by three vertical plates and an inlet opening for oily smoke produced in cooking to pass through, two filter plates mounted in the two passageways to filter oily smoke passing therethrough, a plurality of spray nozzles on water tubes mounted in the two passageways to spray water to mix with oil contained in the oily smoke, so that water mixed with oil can drop down to the bottom of the passageways and then down through an inlet tube leading into a separating tank wherein the oil may float on top of the water in the tank and then the oil may overflow a separating wall to drop down into a waste oil tank for collection.

The water separating from oil in the separated tank can be pumped up to be sprayed out of the spray nozzles for cleaning and mix oil in smoke again, i.e. to be recycled for recleaning the oily smoke.

A clean water tank rather smaller sized than the separating tank is provided in front of the separating tank automatically to supply clean water to the separating tank in case of necessity by means of a level controller mounted in the clean water tank.

The smoke freed of oil by water sprayed out of the nozzles and passing through the filter plates and the passageways becomes quite clean air and is exhausted by a fan.

DETAILED DESCRIPTION OF THE INVENTION

Figure 1:
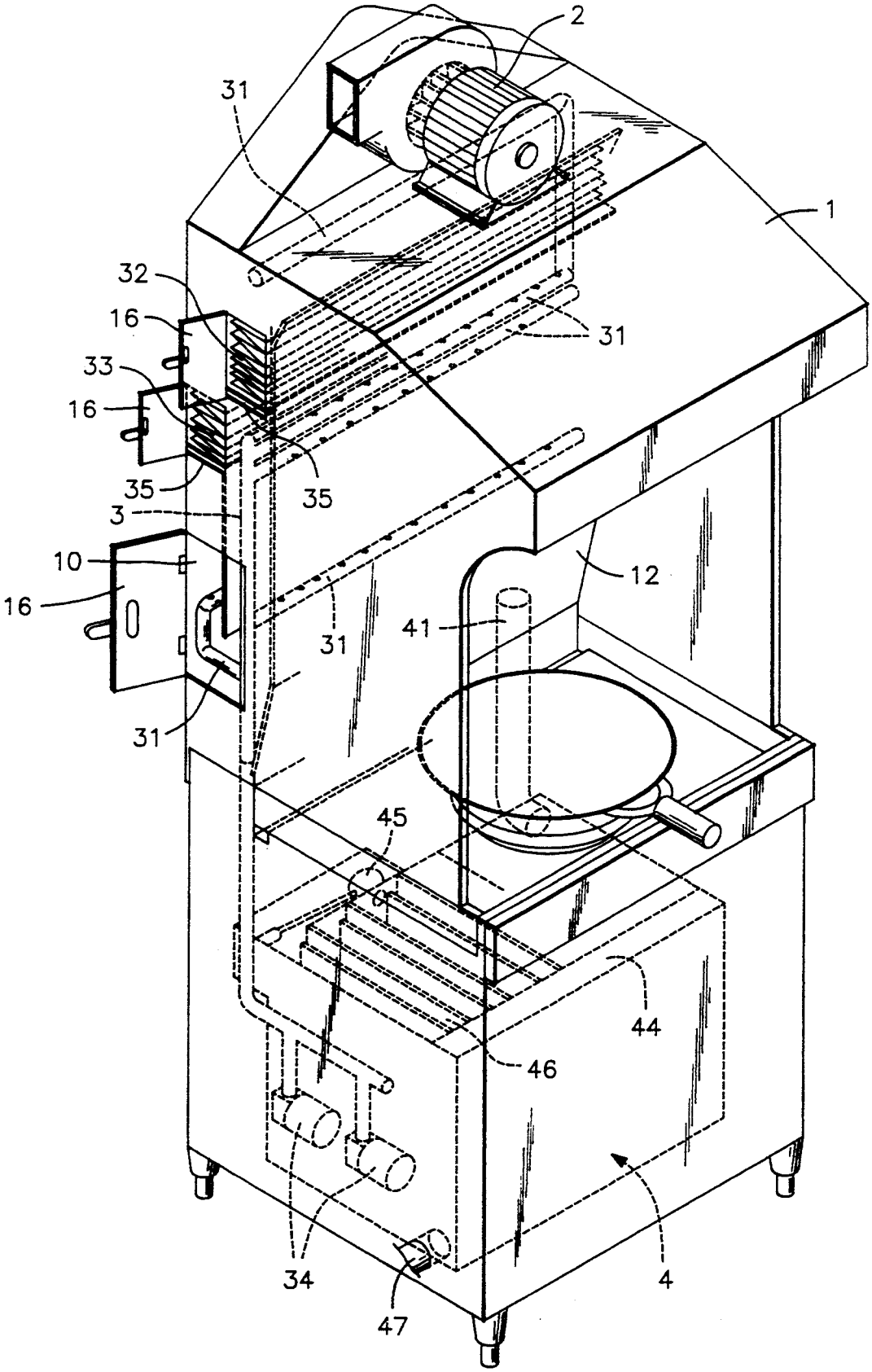
FIG. 1 is a perspective view of a smoke exhausting and treating device of the present invention.

An oily smoke treating and exhausting device in the present invention, as shown in FIG. 1, comprises an upper smoke housing 1, two passageways 10, 10, a fan 2, a filter layer 3, and several tanks 4 combined together.

The upper smoke housing 1 is provided above a cooking stove for receiving and treating oily smoke produced by food being cooked, and the fan 2 with a motor may be placed on an upper surface of the housing 1. The smoke housing 1 has a lighting member 11 mounted therein to give light for convenience of cooking, a front vertical plate 12, an intermediate vertical plate 13 and a rear vertical plate 14. The front vertical plate 12 and the intermediate plate 13 are separated in parallel with each other to form a first passageway 10, and the intermediate 13 and the rear vertical plate 14 are separated in parallel with each other to form a second passageway 10. The two passageways 10, 10 communicate with each other at the bottom of the intermediate plate 13. An inlet opening 15 is provided at the top of the front vertical plate 12 for oily smoke to flow into the first passageway 10 guided by the housing 1, and the opening being at the top also prevents water in the filter plates 3, 3 from flowing out. An upper end of the second passageway 10 is connected with the fan 2, which blows out oily smoke produced, after being showered with water sprayed out of spray nozzles 31, then filtered through the filter plates 32, 33.

The fan and motor combination 2 is mounted on the upper surface of the smoke housing 1, being a conventional fan and motor combination for pumping out clean air after being filtered by the filter plates 32, 33.

The two passageways 10, 10—the first one and the second one—, include a plurality of spray nozzles 31 connected with water tubes and a front filter plate 32 and a rear filter plate 33. The spray nozzles 31 spray out clean water pumped by a water pump 34 from the bottom of a separating tank 43 for cleaning the oily smoke passing through the first and the second passageways 10, 10 and forcing oil mixed in smoke to mix with the water and drop down owing to its large specific gravity into the separating tank 43. The front filter 32 is mounted near the inlet opening 15 in the first passageway 10, made of many layers of bent continuous cotton sheets, or filtering cotton or paper, and sustained by a support rod 35. In order for the two passageways 10, 10 and the spray nozzles 31 to be cleaned and the front filter plate 32 and the rear filter plate 33 to be displaced, several swingable windows 16 are provided in a side wall of the smoke housing 1 as shown in FIG. 1, to be closed or opened.

Figure 2:
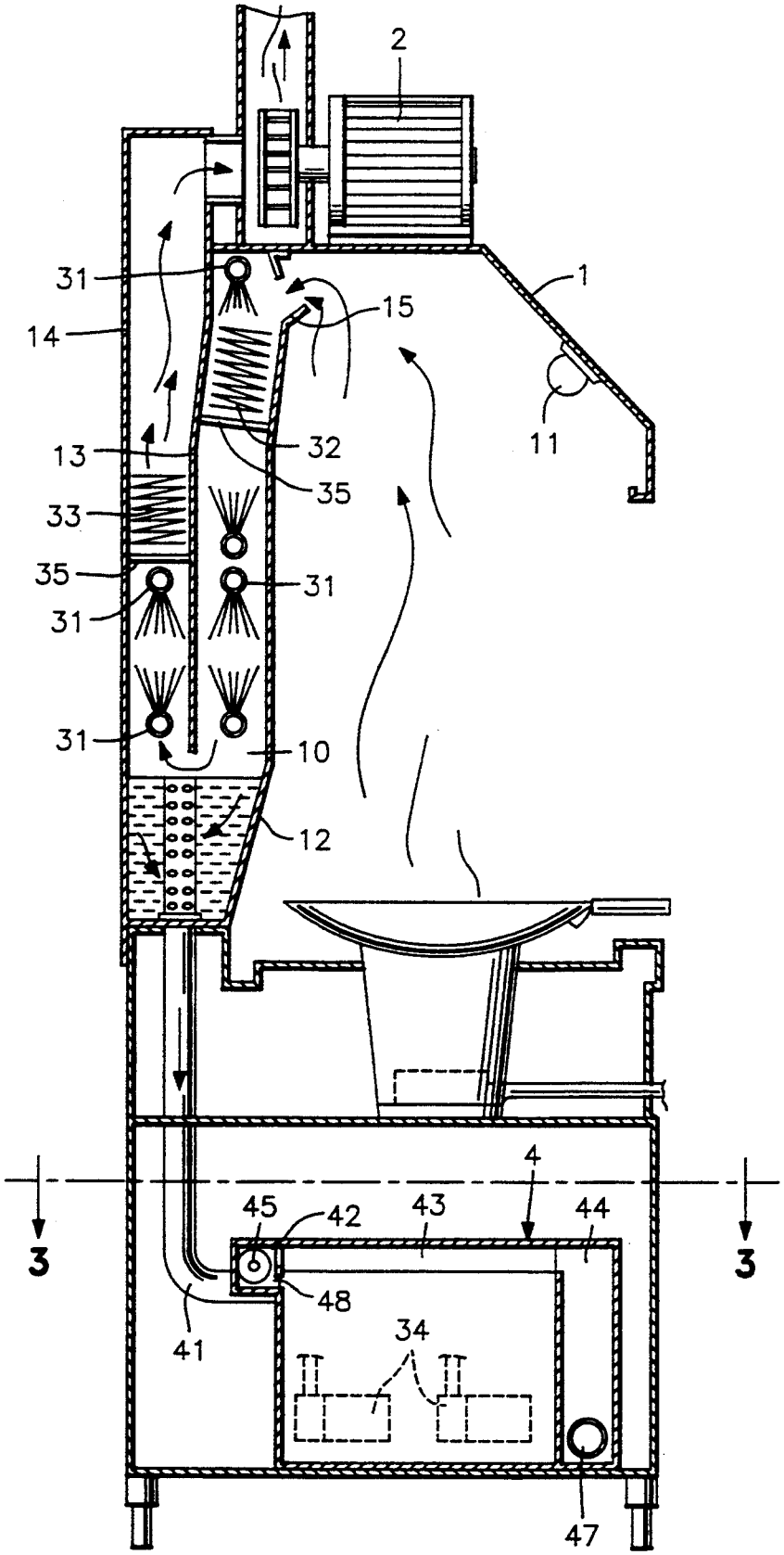
FIG. 2 is a cross-sectional side view of the smoke exhausting and treating device.
Figure 3:
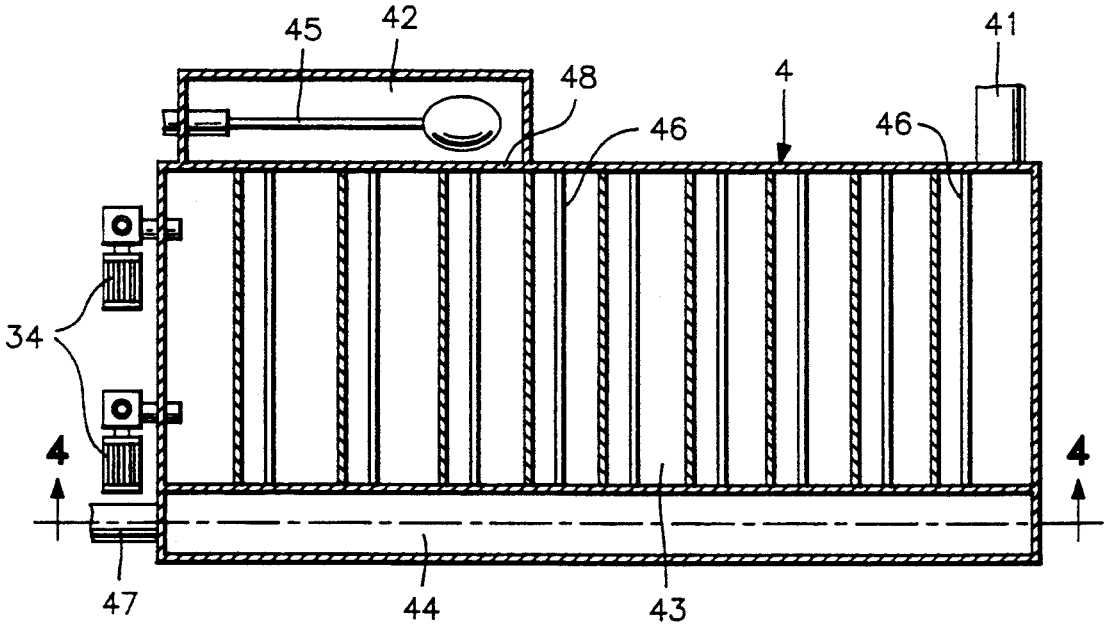
FIG. 3 is a cross-sectional view on line 3—3 in FIG. 2.
Figure 4:
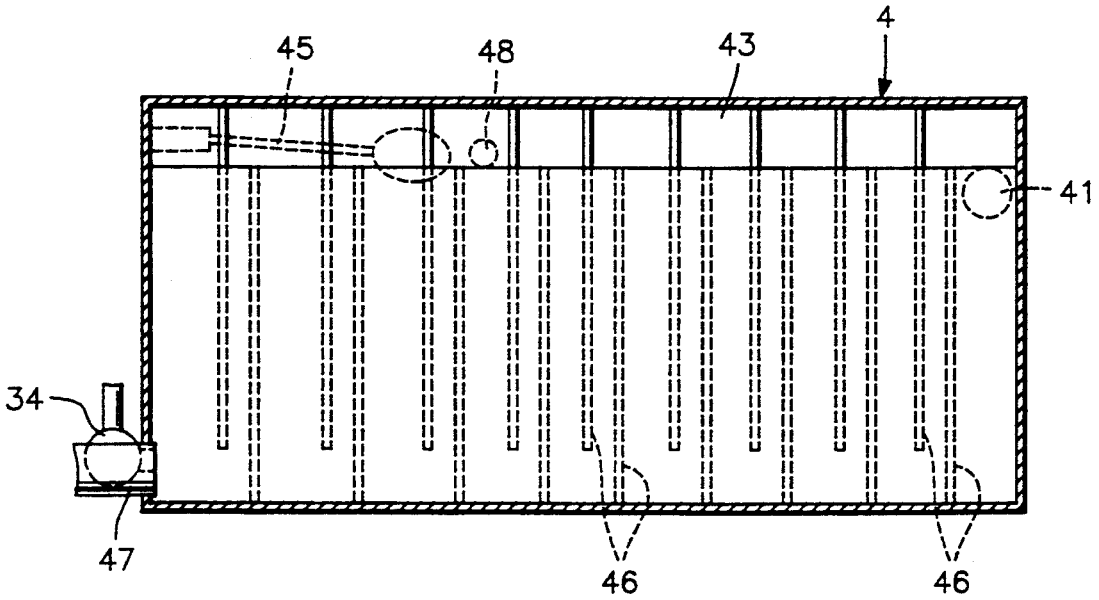
FIG. 4 is a cross-sectional view on line 4—4 in FIG. 3.

The several tanks 4 shown in FIGS. 3 and 4 are installed below the cooking equipment, including a clean water tank 42, a separating tank 43 and a waste oil tank 44 combined continuously together, and an inlet tube 41 provided to guide water mixed with oil from the bottom of the passageways 10, 10 into the separating tank 43. The inlet tube 41 has its upper portion extending into the bottom portion of the passageways 10, 10 as shown in FIG. 2, having many small holes in its circumferential wall for water to flow in and then into the separating tank 43.

The clean water tank 42 has a level controller 45 floatable on the water of the tank 42 so that the level controller 45 can function to let clean water flow into the tank when the water level drops lower than a preset one. The clean water can flow through a side hole 48 into the separating tank 43, and the side hole 48 is located higher than the highest water level of the separating tank 43.

The separating tank 43 receives water mixed with oil coming from the passageways 10, 10 through the inlet tube 41, having no upper side wall, but a plurality baffle of plates 46 vertically mounted in its interior to form many pairs of baffle plates 46, each pair having one plate 46 extending from an upper side but not reaching a bottom side wall and another stop plate extending up from the bottom side wall but not reaching the upper side to form a passageway between them, forcing water coming therein to flow up and down alternately through the passageways formed by the pairs of the baffle plates 46. A side hole 48 is provided in an upper portion of the separating tank 43 to replenish water therein, and two pumps 34 are provided at a lower side position of the separating tank 43 to pump out water. As oil is lighter than water, it does not move along the passageways formed by the pairs of stop plates 46, floating on an upper surface of water in the separating tank 43. When the level of the water in the tank 43 becomes high enough, replenished by clean water from the clean water tank 42, the oil floating on the upper surface of the water therein will overflow into the waste oil tank 44, and then flow out of an exhausting pipe 47.

In summary, the oily smoke treating and exhausting device of the present invention has passageways for oily smoke to pass through, be showered by sprayed water, and filtered by two filter plates, whereby oil in the smoke may mix with water to flow into the separating tank 43 so that the oil can be separated from water to be exhausted or be treated and the clean water without oil can be recycled.

What is claimed is:

1. An oily smoke treating and exhausting device mounted above a cooking stove, comprising:

an upper smoke housing extending horizontally at a spacing above the cooking stove to receive and guide oily smoke mixed in air produced from food cooked on the stove;

three vertical plates including, a front plate, an intermediate plate and a rear plate, extending down from a rear portion of said smoke housing and being spaced apart in parallel to form two passageways, comprising a first passageway between the front plate and the intermediate plate said first passageway having a smoke inlet leading from its housing and a second passageway between the intermediate plate and the rear plate, the first and the second passageway communicating with each other at a bottom end of the intermediate plate for oily smoke mixed in air to flow from said inlet down through the first passageway and up through the second passageway;

a filter means including a plurality of spray nozzles connected with water tubes and a plurality of filter plates in said passageways, said spray nozzles for spraying clean water in said two passageways, to mix the clean water with oil contained in the oily smoke, whereby said water with oil can drop down to the bottom of the passageways, an inlet tube leading from the bottom of the passageways to a separating tank installed below the cooking stove, a clean water tank and a waste oil tank below the stove, a separating wall between the separating tank and the waste oil tank, said clean water tank having a level controller for a pump to replenish water therein if the water level in said clean water tank becomes lower than a preset level, said separating tank having a side hole for clean water in the clean water tank to flow into said separating tank, said clean water tank, the separating tank and the waste oil tank being combined with one another to have respective liquid levels receding from said clean water tank to the separating tank and to the waste oil tank, said separating tank having a plurality of pairs of vertical baffle plates therein to form a flow passageway for liquid to flow from bottom to top and then from top to bottom alternately through the separating tank, enabling oil to separate from water and float on top of the separating tank to overflow said separating wall between said separating tank and said waste oil tank into said waste oil tank, an exhausting tube for flow of oil out of said waste oil tank, a pump means for recycling water from the separating tank to the spray nozzles through said water tubes, and an exhaust fan for drawing the smoke from said smoke inlet through said passages, to an outlet atop the second passage.

2. The oily smoke treating and exhausting device as claimed in claim 1, wherein said passageways formed by said three vertical plates have side wall with openings having swingable windows therein for cleaning or displacing said water tubes connected with the spray nozzles and said filter plates.

* * * * *